United States Patent [19]

Buzzi et al.

[11] 4,400,875

[45] Aug. 30, 1983

[54] DRY-SHAVING APPARATUS

[75] Inventors: Leo Buzzi; Romuald L. Bukoschek, both of Klagenfurt, Austria

[73] Assignee: U.S. Philips Corporation, New York, N.Y.

[21] Appl. No.: 264,734

[22] Filed: May 18, 1981

[30] Foreign Application Priority Data

Jul. 28, 1980 [AT] Austria ..... 3922/80

[51] Int. Cl.[3] ..... B26B 19/28; B26B 19/04

[52] U.S. Cl. ..... 30/43.92

[58] Field of Search ..... 30/43.92, 45; 310/41, 310/50, 163, 80

[56] References Cited

U.S. PATENT DOCUMENTS

| | | | |
|---|---|---|---|
| 2,219,552 | 10/1940 | Andis | 30/43.92 |
| 2,265,382 | 12/1941 | Martin | 30/43.92 |
| 2,287,337 | 6/1942 | Zimmerman | 30/43.92 |
| 3,848,146 | 8/1973 | Tourtellot et al. | 310/163 |
| 4,210,832 | 7/1980 | Ascoli | 310/50 |
| 4,274,024 | 6/1981 | Gottschalk | 310/41 X |

*Primary Examiner*—Harold D. Whitehead
*Assistant Examiner*—Robert A. Rose
*Attorney, Agent, or Firm*—Thomas A. Briody; William J. Streeter; Rolf E. Schneider

[57] ABSTRACT

In a dry-shaving apparatus which is adapted to be connected to an a.c. source and which comprises at least one reciprocating cutter, there is provided a self-starting single-phase synchronous motor for driving the cutter. Via at least one drive mechanism, which couples the drive spindle of the motor to the cutter and which converts the rotary movement of the drive spindle into a reciprocating movement of the cutter, the cutter is made to occupy substantially one of the two extreme positions in its reciprocating movement in those positions of the rotor of the motor in which the driving torque has zero value.

7 Claims, 5 Drawing Figures

DRY-SHAVING APPARATUS

This invention relates to a dry-shaving apparatus for connection to an a.c. mains or source, which apparatus comprises at least one reciprocatory cutter and an electric motor whose rotor is connected to a drive spindle which is coupled to the cutter via at least one drive mechanism, said mechanism converting the rotary movement of the drive spindle into a reciprocating movement of the cutter.

Such a dry-shaving apparatus is for example described in U.S. Pat. No. 4,167,060. The electric motor in this known dry-shaving apparatus is a d.c. motor which if the apparatus is to be connected to an a.c. mains should be energized via a rectifier circuit and voltage-adapting circuit elements, which arrangement demands additional circuitry and leads to a substantial reduction of efficiency. If a commonly used a.c. motor, such as an induction motor or a universal motor, were employed directly, allowance would have to be made for the comparatively low efficiency which is inherent in such motors. For these reasons dry-shavers of the type mentioned in the opening paragraph generally employ oscillating-armature motors, which have a higher efficiency but are comparatively bulky.

The mechanism by means of which, when normal electric motors are employed, the rotary movement of the drive spindle is converted into an oscillatory movement for driving the cutter generally comprises an eccentric which is, for example, adapted to cooperate directly with the cutter or to drive said cutter via an oscillating bridge, as is described in the above U.S. Patent.

It is an object of the present invention to make a dry-shaving apparatus of the type mentioned in the opening paragraph as small and handy as possible, which objective demands the use of an electric motor of minimal dimensions because these dimensions in fact determine the size of the housing of the dry-shaving apparatus, whilst maintaining a satisfactory shaving action which inter alia requires the use of a more powerful electric motor. However, these two requirements with which the electric motor should comply, namely being both powerful and compact, are obviously conflicting.

According to the invention said object is achieved in that the electric motor is a self-starting single-phase synchronous motor and that the relative position of the rotor about its axis with respect to the position of the cutter which is coupled thereto via the drive mechanism is selected so that in any rotor position in which the driving torque of the motor has zero value the cutter substantially occupies one of the two extreme positions of its reciprocating movement. A self-starting single-phase synchronous motor has a high efficiency, which means that it has comparatively small dimensions at a specific power. However, allowance is to be made for the fact that a self-starting single-phase synchronous motor has two rotor positions in which the driving torque has zero value, and the fact that its rotor should have specific angular rest positions which are slightly displaced from the first-mentioned rotor positions in order to ensure self-starting. In addition, the load on the motor should not be too high in these rest positions of the rotor, in order to ensure that the motor is automatically started. Moreover, the load on the motor in those rotor positions in which the driving torque has zero value should not be too high, in order to ensure that when the motor is switched off the rotor can assume one of its rest positions and the motor can be started automatically again. Therefore, it has been assumed until now that a self-starting single-phase synchronous motor can only be used in those cases where either the motor load is very low or where the power transmission is such that it leads to a speed reduction and thus to a smaller motor load. These assumptions have apparently prohibited the use of self-starting single-phase synchronous motors in dry-shavers, because the drive of the cutter exerts a substantial load on the motor and in dry-shavers the rotational speed of such a motor, which is dictated by the mains frequency, cannot be reduced because the frequency of the reciprocating motion with which the cutter is driven should not be too low in order to obtain a satisfactory shaving action. By means of the invention these problems are overcome, because the drive mechanism couples the drive spindle of the motor to the cutter in such a way that in those rotor positions in which the driving torque has zero value, the cutter is situated substantially in one or the other of the two extreme positions in its reciprocating movement. In the two extreme positions of the cutter, which correspond to the points of reversal of the direction of the reciprocating movement of said cutter, when the cutter momentarily stops, the loading torque exerted by the cutter is substantially zero. By this special adaptation of the phase of the movement of the cutter to the rotor movement of the self-starting single-phase synchronous motor each instant of zero driving torque of the motor coincides with an instant of zero loading torque of the cutter, so that all requriements for a correct automatic starting of the motor are met and said motor is therefore suitable for use in a dry-shaver with a reciprocating cutter thereby enabling a compact and easy-to-handle shaver to be obtained.

In the case of a self-starting single-phase synchronous motor the frequency of the rotary movement of its drive spindle is equal to the mains frequency, that is, for example, 50 Hz, because it comprises one pole-pair. However, in dry-shavers it is often advantageous if the frequency of the reciporocating movement of the cutter is higher. Accordingly, it is found to be advantageous if there are provided two drive mechanisms which are arranged to operate in series and of which one mechanism is an eccentric mechanism and serves for converting the rotary movement of the drive spindle into an oscillatory movement for driving the cutter and the other mechanism serves to obtain a frequency of the oscillatory cutter-drive movement which is an integral multiple of the frequency of the rotary movement of the drive spindle. In this way the frequency of the reciprocating movement of the cutter can be increased, for example to 100 Hz, in the same way as in dry shavers with an oscillating-armature motor, whilst maintaining the advantages already mentioned which a self-starting single-phase synchronous motor has in comparison with an oscillating-armature motor. The requirement that the drive mechanism should provide a frequency of the oscillatory cutter-drive movement which is an integral multiple of the frequency of the rotary movement of the drive shaft ensures that in any rotor position in which the driving torque has zero value, the cutter substantially occupies one or the other of the two extreme positions in its reciprocating movement, so that self-starting of the motor is always guaranteed.

For a simple construction of the dry-shaving apparatus it is found to be advantageous if the mechanism which multiplies the frequency of the oscillatory cutter-drive movement by an integer is constituted by a gear mechanism comprising at least two gear wheels, of which the first gear wheel is mounted on the drive-spindle of the self-starting single-phase synchronous motor and of which the last gear wheel is coupled to an eccentric, which cooperates with the mechanism for converting the rotary movement of the drive spindle into an oscillatory movement for driving the cutter. Thus, the frequency of the reciprocating movement of the cutter can simply be doubled or even tripled relative to the frequency of the rotary movement of the drive spindle.

A very simple and reliable construction is also obtained if the mechanism for multiplying the frequency of the oscillatory cutter-drive movement by an integer is constituted by a toggle mechanism in which a drive arm, which acts on the free pivot of the toggle mechanism, is connected to an eccentric of the toggle mechanism for converting the rotary movement of the drive spindle into an oscillatory movement for driving the cutter, which eccentric is driven by the self-starting single-phase synchronous motor, and the power take-off end of the toggle mechanism provides the oscillatory movement for driving the cutter. Thus, the frequency of the reciprocating movement of the cutter is simply doubled relative to that of the rotary movement of the drive shaft, whilst moreover the requirement that the frequency should be multiplied by an integer is met.

For a simple construction it is also found to be very advantageous if there is provided a single drive mechanism in the form of a cam mechanism, by means of which the rotary movement of the drive spindle is converted into an oscillatory movement for driving the cutter and the frequency of the oscillatory cutter-drive movement is multiplied by an integer relative to the frequency of the rotary movement of the drive spindle.

It is advantageous if the cam mechanism is a double-cam mechanism, the oscillatory movement for driving the cutter being jointly provided by the two adjacent cams of said mechanism which cams are arranged at different angles relative to each other. In this way the frequency of the oscillatory movement of the cutter is doubled in comparison with the rotary movement of the drive spindle, simultaneously with the conversion of the rotary movement of the drive spindle into an oscillatory movement for driving the cutter, so that the requirement that the frequency should be an integral multiple is automatically met.

Suitably, the cam mechanism is constituted by a cam of which the profile has the shape of an equilateral triangle with convexly, identically curved sides, the cam being driven at its centre of gravity, and the oscillatory movement for driving the cutter being taken off at the circumference of the cam. Thus, the frequency of the reciprocating movement of the cutter is simply tripled relative to the frequency of the rotary movement of the drive spindle, simultaneously with the conversion of the rotary movement of the drive spindle into an oscillatory movement for driving the cutter, whilst again the requirement that the frequency should be multiplied by an integer is met automatically.

The invention will now be described in more detail with reference to the accompanying drawings, in which some embodiments are shown, partly schematically and partly in longitudinal section.

Figure 1:
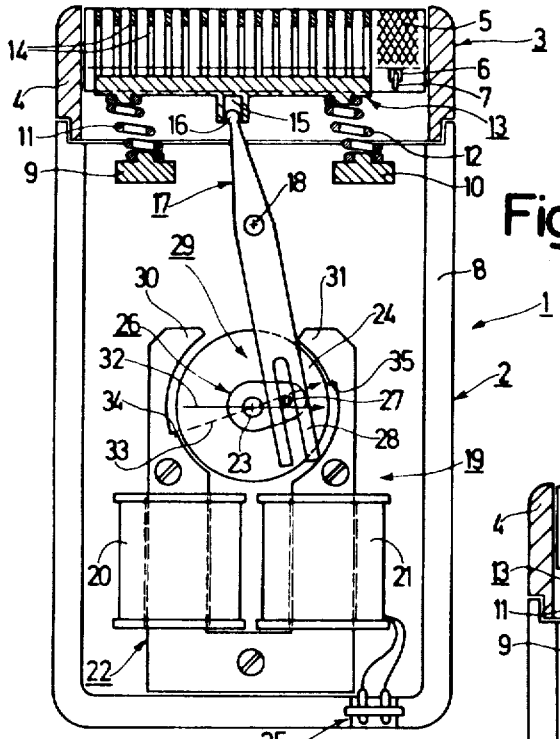
FIG. 1 shows a dry-shaving apparatus with a self-starting single-phase sychronous motor, which drives the cutter via an eccentric and an oscillating lever, the position in which the moving parts are shown corresponding to a rotor position in which the driving torque has zero value.

In FIG. 1 a dry-shaving apparatus is designated 1, which apparatus comprises a housing 2 on which a shaving head 3 is mounted. The shaving head 3 comprises a shaving-head frame 4, which carries an arched shear foil 5, which by means of openings 6 formed in its longitudinal edges is attached to correspondingly arranged hooks 7 on the shaving-head frame. The housing 2 comprises two housing halves, of which housing half 8 is visible in FIG. 1. At the end of said housing half 8 which is adjacent the shaving head 3 there are provided two members 9 and 10, which each carry a helical spring 11 and 12 respectively. To these helical springs a cutter 13 is secured, which cutter comprises a plurality of arcuate cutter blade 14 which, when the shaving head 3 is placed on the housing 2, cooperates with the shear foil 5. The springs 11 and 12 then provide the pressure for urging the cutter 13 against the shear foil 5. The cutter 13 is adapted to be driven with a reciprocating movement, for which purpose it has a recess 15, with which the free end 16 of the oscillating lever 17 engages, which lever is pivotal about a spindle 18 provided on the housing half 8. An electric motor 19 is secured to the housing half 8, which motor comprises a stator 22, provided with exciter coils 20 and 21, and a rotor 24, which is connected to a drive spindle 23. The exciter coils 20 and 21 are connected, if necessary via a switch, not shown, to a connector 25, to which can be connected a mains lead via which the apparatus can be connected to an a.c. mains or source. Mounted on the drive spindle 23 is an eccentric 26, which by means of an eccentric pin 27 engages with the forked end 28 of the oscillating lever 17, which end is remote from the free end 16. In this way the eccentric 26 and the oscillating lever 17 constitute a drive mechanism between the drive spindle 23 and the cutter 13, via which mechanism the rotary movement of the drive spindle is converted into a reciprocating movement of the cutter. Obviously, the construction of such mechanism 29 is not limited to that of the present embodiment; for example, with a suitable arrangement of the motor 19 relative to the cutter 13 the eccentric pin 27 may engage directly with the recess 15 in the cutter, or instead of an oscillating lever an oscillating bridge or the like may be provided.

In the dry-shaving apparatus in accordance with the invention the electric motor is a self-starting single-phase synchronous motor. A self-starting single-phase synchronous motor of small dimensions is comparatively powerful owing to its very high efficiency, so that a dry-shaving apparatus equipped with such a motor can be made comparatively small and convenient-to-handle, whilst providing a satisfactory shaving action. Therefore, such a dry-shaving apparatus is inexpensive and particularly convenient-to-use.

The rotor 24 of the self-starting single-phase synchronous motor is partially surrounded by the arcuate surfaces of the U-shaped limbs 30 and 31 of the stator 22. The cylindrical rotor 24, which is made of a magnetisable material, is magnetised in a diametrical direction, as is represented by the arrow 32, so that on its circumferential surface, opposite each other, an N-pole and an S-pole are obtained, which constitute a pole pair. Hence, two positions of the rotor 24 are obtained in which the driving torque has zero value. Such a position, as is shown in FIG. 1, is obtained if the magnetic field of the rotor 24 extends transversely of the limbs 30 and 31 of the stator 22 as indicated by the arrow 32. The rotor 24 of a self-starting single-phase synchronous motor requires specific rest positions which deviate angularly slightly from a rotor position in which the driving torque has zero value in order to ensure that it can start automatically. The two rotor positions which correspond to a zero driving torque as well as the two rest positions of the rotor are spaced 180° from each other and are perfectly equivalent, so that hereinafter reference will be made to only one of the two zero-torque positions and only one of the two rest positions.

In practice, the angular deviation of the rest position of the rotor 24, which position is represented by the broken-line arrow 33 in FIG. 1, from the rotor position in which the driving torque has zero value is of the order of 10° to 25°, as is apparent from the angular positions of the two arrows 32 and 33 in FIG. 1. This rest position is defined by an appropriate shaping of the arcuate surfaces of the limbs 30 and 31 of the stator, a non-uniform air gap being formed, for example by means of the projections 34 and 35 shown in FIG. 1. In this way a so-called "detent torque" is produced in conjunction with the magnetic field of the rotor, which torque ensures that when the motor is disconnected from the a.c. mains the rotor 24 will occupy a rest position and not a position in which the driving torque has zero value, which would prohibit self-starting.

In order to ensure that a self-starting single-phase synchronous motor is in fact self-starting, it is necessary that its load in any rotor position in which the driving torque has zero value is very small, namely smaller than its detent torque, in order to allow the rotor to occupy its rest position when the motor is disconnected from the a.c. mains, and not any other position from which the motor could not start automatically. Also, in the rest position of the rotor the load on the motor should not be too high in order to ensure that in this rest position of the rotor the comparatively small driving torque occurring when the motor is switched on suffices to set the rotor in motion.

In order to guarantee such a small load in the critical position of the rotor of the self-starting single-phase synchronous motor 19 the invention utilises the fact that a reciprocating cutter exerts a varying loading torque, which in the two extreme positions in its reciprocating movement, which are the points of reversal of the direction of movement of the cutter, when the cutter momentarily stops, also has zero value. If the instants of zero driving torque of the motor coincide at least substantially with the instance of zero loading torque of the cutter, it is ensured that in the critical position of the rotor the load is substantially zero, thereby satisfying the requirements for reliable automatic starting of the motor. This phase relationship between the cutter movement and the rotor movement is obtained by the mechanism 29 ensuring that the relative positions of the rotor 24 and the cutter 13 are such that in any position of the rotor in which the driving torque has zero value the cutter substantially occupies one or the other of the two extreme positions in its reciprocating movement. In the embodiment of FIG. 1 this is simply achieved by mounting the eccentric 26 on the drive spindle 23 in such a way that in each position of the rotor in which the driving torque has zero value the eccentric pin 27 defines an extreme position for the oscillating lever 17 and thus for the cutter 13, as will be apparent from FIG. 1. In the rest position of the rotor 24, which is indicated by the arrow 33 in FIG. 1, the cutter 13 is then slightly out of its extreme position. This departure from the extreme position, which corresponds to the angular difference between the arrows 32 and 33, is only very small, because in this part of the movement of the eccentric 26 the resulting displacement of the oscillating lever 17 is also very small. This means that any deviations from the actually desired position of the cutter are not significant, which is very important in view of assembly tolerances, because it is then still ensured that the motor can start automatically despite said tolerances.

In practice the eccentric 26 can be mounted on the drive spindle 23 in a rest position of the rotor 24, the corresponding angular difference between the rest position and that rotor position in which the driving torque has zero value being allowed for by a corresponding change of the actual position of the cutter defined by the mechanism 29, relative to its extreme position. As is shown in FIG. 1, the left-hand extreme position in the reciprocating movement of the cutter 13 in the present embodiment is made to correspond to a position of the rotor 24 in which the driving torque has zero value; obviously, the right-hand extreme position of the cutter may also be used for this purpose in the same way. As the frequency of the rotary movement of the drive spindle 23 of a self-starting single-phase synchronous motor having one pole pair, as stated previously, is equal to the mains frequency, the cutter 13 in the present embodiment will perform a reciprocating movement of a frequency equal to the mains frequency.

Thus, as can be seen, it is readily possible to employ a self-starting single-phase synchronous motor for driving a reciprocating cutter in a dry-shaving apparatus if, via the mechanism which couples the drive spindle to the cutter, the cutter movement is locked to the rotor movement of the motor with the correct phase with respect to the variation of the driving torque and the loading torque, in order to ensure that the motor is actually capable of starting automatically. The use of such a motor than enables a very compact construction of the dry-shaving apparatus to be obtained, whilst nevertheless sufficient power for driving the cutter is available to guarantee a correct shaving action.

In shaving apparatus of the present type, it is frequently desirable that the frequency of the movement of the cutter is higher than the mains frequency, because this ratio improves the shaving action. For this reason, in the embodiment shown in FIG. 2 there are provided two drive mechanisms, operating in series. One drive mechanism 29, which is constituted by an eccentric mechanism, serves for converting the rotary movement of the drive spindle 23 into an oscillatory movement for driving the cutter 13, and the other drive mechanism 36 serves for multiplying the frequency of this oscillatory movement relative to the frequency of the rotary movement of the drive spindle 23 by an integer. The drive mechanism 36 is a gear mechanism having two gear wheels 37 and 38, of which the first gear wheel 37 is mounted on the drive spindle 23 of the self-starting single-phase synchronous motor 19. The second gear wheel 38, which meshes with the gear wheel 37, is rotatably journalled on the housing half 8 by means of a spindle 39 and has exactly half the number of teeth of the gear wheel 37, so that the gear wheel 38 makes twice the number as rotations of the gear wheel 37, as a result of which the frequency of the oscillatory movement for driving the cutter is exactly multiplied by an integer so that the relative positions of the rotor 24 and the cutter 13 always remain unchanged.

The drive mechanism 29 for converting the rotary movement of the drive spindle into an oscillatory movement for driving the cutter is constituted by an eccentric mechanism, for which purpose there is provided an eccentric pin 27 on the gear wheel 38, on which pin a connecting rod 40 is mounted, which is connected to the oscillating lever 17 via an integral hinge 41. In this way the cutter 13 performs a reciprocating movement of twice the frequency of the rotary movement of the drive shaft 23.

Figure 2:
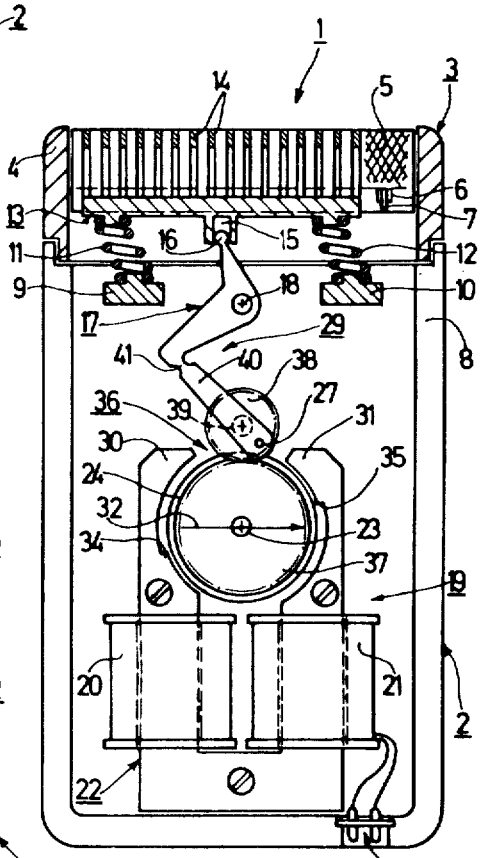
FIG. 2 shows a dry-shaving apparatus of a similar type, in which the frequency of the oscillatory movement for driving the cutter is doubled relative to the frequency of the rotary movement of the drive shaft by means of a gear mechanism.

In order to ensure that in this case also the movement of the cutter 13 is locked to the movement of the rotor 24 of the self-starting single-phase synchronous motor 19 with the correct phase, the gear wheel 38 is made to mesh with the gear wheel 37 in such a way that in the position of the rotor 24 in which the driving torque has zero value, which position is represented by the arrow 32 in FIG. 2, the eccentric pin 27 moves the oscillating lever 17 into an extreme position via the connecting rod 40, in which position the cutter 13 is also in one of the two extreme positions in its reciprocating movement. As can be seen in FIG. 2, the left-hand extreme position is again selected for this by way of example. In this respect it is essential, as stated previously, that the transmission ratio of the gear mechanism 36 is an exact integral number, because only then it is ensured that the phase of the movement of the cutter 13 does not change relative to the movement of the rotor 24.

Thus, when the frequency of the reciprocating movement of the cutter 13 is doubled relative to the frequency of the rotary movement of the drive spindle 23, it is also ensured, that in those positions of the rotor 24 in which the driving torque has zero value the cutter always occupies one of the two extreme positions in its reciprocating movement, in which positions the loading torque exerted by the cutter also has zero value, so that in these positions the moving parts exert no load on the motor and again the requirements for automatic starting of the motor are met.

Obviously, it is alternatively possible to construct the gear mechanism so that it provides a multiplication of the frequency of the oscillatory movement for the cutter by an integral number greater than two, for example, three. Suitably, the teeth of such a gear mechanism, as is known per se, are made slightly elastic, so that impact loads, as may occur for example, when the motor is switched on, can be absorbed.

Figure 3:
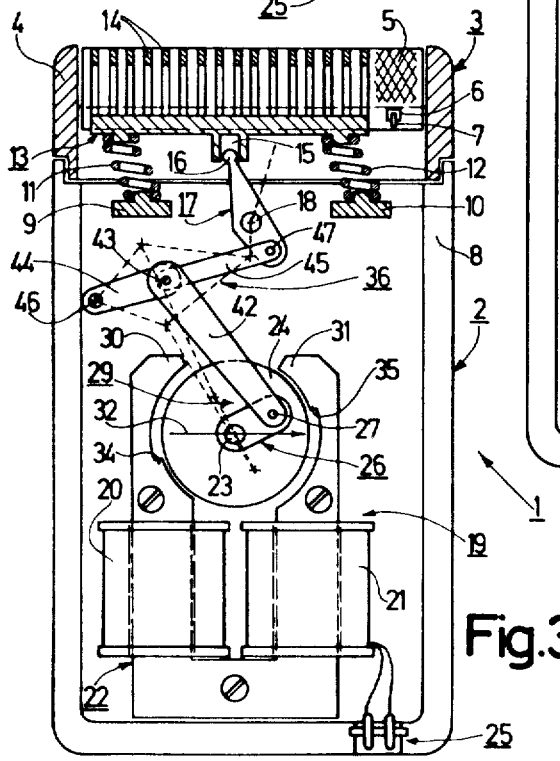
FIG. 3 shows a dry-shaving apparatus in which the frequency of the oscillatory cutter-drive movement is doubled relative to the frequency of the rotary movement of the drive shaft by means of a toggle mechanism.

The dry-shaving apparatus shown in FIG. 3 also comprises two drive mechanisms 29 and 36 operating in series, of which the drive mechanism 29, which is constructed as an eccentric mechanism, serves for converting the rotary movement of the drive spindle 23 into an oscillatory movement for driving the cutter 13, and of which the other drive mechanism 36 serves for doubling the frequency of this oscillatory movement relative to the frequency of the rotary movement of the drive spindle. Again drive mechanism 29 comprises an eccentric 26 mounted on the drive spindle 23 and carrying an eccentric pin 27, to which a drive arm 42 is pivotally connected, which arm cooperates with the drive mechanism 36. This drive mechanism 36 is a toggle mechanism. It comprises two levers 44 and 45 which are connected to each other by a free pivot 43, the lever 44 being journalled on a pin 46 on the housing half 8, and the lever 45 being connected to the oscillating lever 17 by a pivot 47. The pivot 47 then constitutes the power take-off end of the toggle mechanism. The drive arm 42 is articulated to the free pivot 43, so that the movement of the eccentric 26 is transmitted to the toggle mechanism. In the central position of the levers 44 and 45 shown in FIG. 3 the cutter 13 always occupies one of two extreme positions in its reciprocating movement, whilst the cutter 13 occupies its other extreme position when the two levers 44 and 45 are in one or the other of their two extreme positions in which they are fully pivoted away from their central position, which extreme positions are represented by broken lines in FIG. 3. In this way the frequency of the oscillatory movement for driving the cutter 13 is doubled relative to the frequency of the rotary movement of the drive spindle 23 by means of the toggle mechanism.

As can be seen in FIG. 3, the eccentric 26 is again mounted on the drive spindle 23 in such a way that in the position of the rotor 24 indicated by the arrow 32 in FIG. 3, in which position the driving torque has zero value, the cutter 13 is set to one of the two extreme positions in its reciprocating movement via the drive mechanism 29 and the drive mechanism 36, in which positions no load is exerted on the motor. Since such a toggle mechanism inherently multiplies the drive frequency by an integer, namely two, it is again guaranteed that the phase of the movement of the cutter 13 does not change relative to the movement of the rotor 24. Thus, it is again achieved that the self-starting single-phase synchronous motor will always start automatically.

Figure 4:
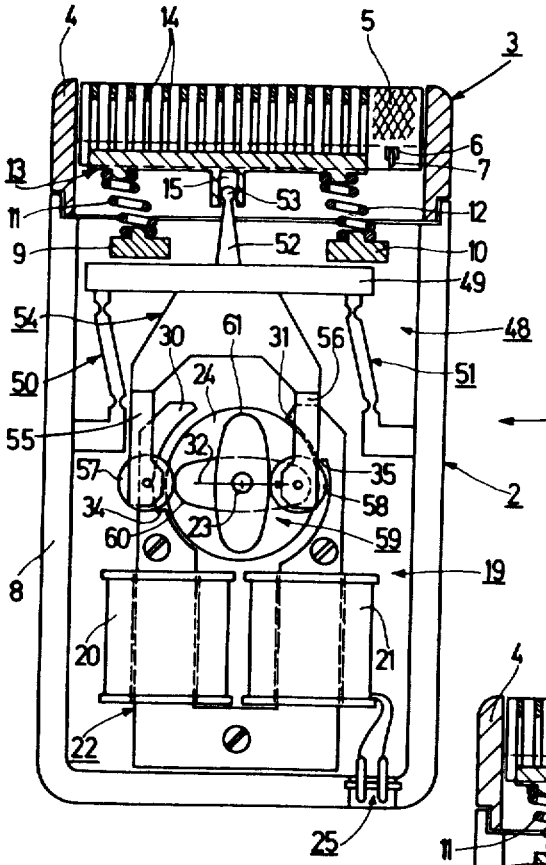
FIG. 4 shows a dry-shaving apparatus in which the rotary movement is converted into an oscillatory movement and the frequency of the oscillatory movement is doubled by means of a double-cam mechanism.

In the embodiment shown in FIG. 4 the cutter 13 is reciprocated by an oscillating bridge 48. In the usual manner this oscillating bridge 48 comprises a plate 49, which via two strip-shaped integral hinges 50 and 51 is pivotally connected to the housing half 9 so that it can perform an oscillatory movement. On the plate 49 there is arranged an arm 52, whose free end 53 engages with the recess 15 formed in the cutter 13, so that the movement of the oscillating bridge 48 is transmitted to the cutter 13. Also secured to the plate 49 is a U-shaped yoke 54 whose two limbs 55 and 56 carry rotatable rollers 57 and 58 respectively at their face ends, which rollers serve for imparting an oscillatory movement to the oscillating bridge 48, as will be explained hereinafter.

In the present embodiment there is provided a single drive mechanism, namely a cam mechanism by means of which the rotary movement of the drive spindle 23 is converted into an oscillatory movement for driving the cutter 13 and the frequency of this oscillatory movement is multiplied by an integral number relative to the frequency of the rotary movement of the drive spindle 23. The mechanism is a double-cam mechanism 59 mounted on the drive spindle 23, which mechanism comprises two adjacent cams 60 and 61, arranged at different angles, the cams jointly providing via the rollers 57 and 58 on the oscillating bridge 48, the oscillatory movement for driving the cutter 13. By means of this double-cam mechanism the frequency of the oscillatory movement for driving the cutter 13 is doubled relative to the frequency of the rotary movement of the drive spindle 23. The two cams 60 and 61 are arranged at 90° relative to each other and each of said cams cooperates permanently with a respective one of the rollers 57 and 58, namely the roller 57 with the cam 60 and the roller 58 with the cam 61. The profiles of the two cams 60 and 61 are so adapted to each other that the two rollers 57 and 58 uniformly follow the associated cams in any angular position or phase of the movement, so that the oscillating bridge 48 is uniformly oscillated. Suitably, one of the two rollers is made slightly elastic at its circumference in order to allow for possible tolerances and to ensure a correct engagement of each roller with the relevant cam. Alternatively, the oscillating bridge 48 may cooperate with springs which act in the direction of its oscillatory movement, in order to provide a vibratory system for the cutter 13, in the direction of driving. As can be seen, a single cam mechanism 59 thus both converts the rotary movement of the drive spindle 23 into an oscillatory movement for driving the cutter 13 and doubles the frequency of this oscillatory movement relative to the frequency of the rotary movement of the drive spindle. Obviously, it is alternatively possible to provide an oscillating lever instead of the oscillating bridge for driving the cutter, in which case the cams should be adapted to the transmission of such movement. Conversely, in the other embodiments the oscillating lever may of course be replaced by an oscillating bridge.

The two cams 60 and 61, which may be formed integrally, are again arranged on the drive spindle 23 in such a way that in the position of the rotor 24 represented by the arrow 32 in FIG. 4, in which the driving torque has zero value, the cutter 13 is set to one of the two extreme positions in its reciprocating movement via the oscillating bridge 48. Thus, it is again ensured that the movement of the cutter 13 is adapted to the phase of the movement of the rotor 24 of the self-starting single-phase synchronous motor 19 in such a way that in those positions of the rotor 24 in which the driving torque has zero value the loading torque exerted by the cutter also has zero value, thereby again ensuring that the motor will start automatically. Since the double-cam mechanism again multiplies the drive frequency by an integral number, it is also ensured that the phase of the movement of the cutter 13 relative to the movement of the rotor 24 does not change, so that the requirements for automatic starting of the motor are always met.

In the embodiment shown in FIG. 5 there is again provided an oscillating lever 17 for driving the cutter 13. Again a cam mechanism is employed by means of which the rotary movement of the drive spindle 23 is converted into an oscillatory movement for driving the cutter 13 and the frequency of this oscillatory movement is multiplied by an integral number relative to the frequency of the rotary movement of the drive spindle 23. In the present case said cam mechanism comprises a cam 62, of which the profile 63 has the shape of an equilateral triangle with convexly, identically curved sides. The cam 62 is mounted on the drive spindle 23 in such a way that it is driven at its centre of gravity. The end of the oscillating lever 17 which is remote from the free end 16 is formed as a U-shaped yoke, whose two limbs 64 and 65 straddle the cam 62 and engage its circumferential surface. The profile 63 of the cam has the property that the distance between any two parallel lines tangential to the profile 63 is the same as the distance between any other two parallel lines tangential to this profile. This property ensures that the two limbs 64 and 65 of the oscillating lever 17 always cooperate with the circumferential surface of the cam 62. As a result, the oscillating lever 17 will follow, the instantaneous angular position or phase of movement of the cam 62. Suitably, the circumferential surface of the cam is constituted by involute surfaces in order to ensure a uniform cycle of movements. Since the cam 62 is driven at its centre of gravity and not away from the centre, it is ensured that in the movement taken off at the circumference of the cam no stationary intervals occur, so that a continuous movement is obtained during each revolution of the cam. Since the cam has three peaks or vertices, the frequency of the rotary movement of the drive spindle 23 is tripled, so that the frequency of the reciprocating movement of the cutter 13 is also tripled relative to the frequency of the rotary movement of the drive spindle 23.

Figure 5:
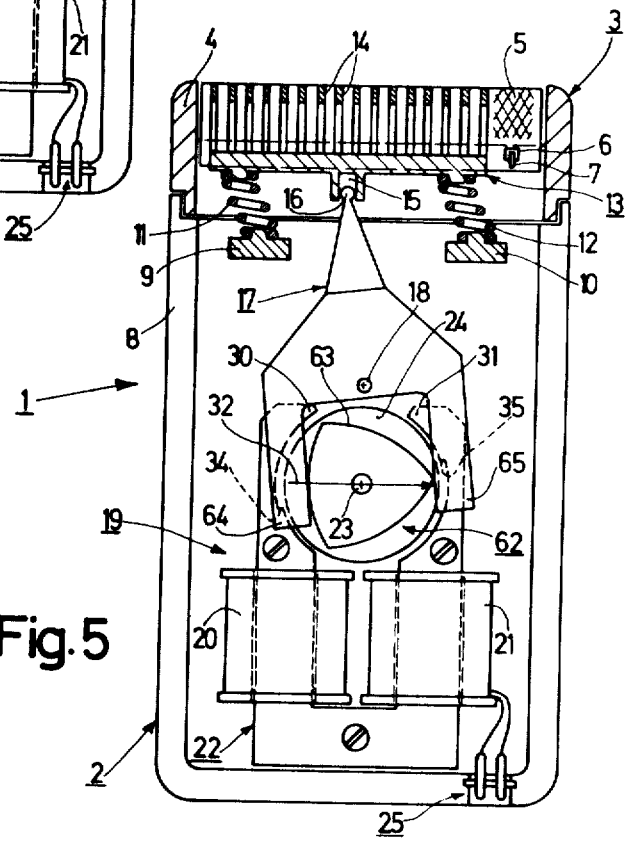
FIG. 5 shows a dry-shaving apparatus in which the rotary movement is converted into an oscillatory movement and the frequency of the oscillatory movement is tripled by means of a cam having the shape of an equilateral triangle with convexly curved sides.

Again the cam 62 is mounted on the drive spindle 23 is such a way that in the position of the rotor 24 represented by the arrow 32 in FIG. 5, in which position the driving torque has zero value, the cutter 13 is set to one of the two extreme positions in its reciprocating movement via the oscillating lever 17. Thus, it is again ensured that the movement of the cutter 13 is locked to the phase of the movement of the rotor 24 of the self-starting single-phase synchronous motor 19 in such a way that in those positions of the rotor 24 in which the driving torque has zero value the loading torque exerted by the cutter also has zero value, thereby ensuring reliable automatic starting of the motor. Since the cam mechanism multiplies the drive frequency by an integral number, it is again ensured that the phase of the movement of the cutter 13 relative to the movement of the rotor 24 does not change, so that the requirements for self-starting of the motor are always met.

Obviously, various modifications of the embodiments described in the foregoing are possible without departing from the scope of the invention. In this respect it is to be noted that the use of a self-starting single-phase synchronous motor is of course not limited to the drive of a cutter which cooperates with a shear foil, that is, a shaving element for cutting short hairs, but that by means of such a motor, in order to obtain the same advantages, it is for example also possible to drive the cutter of a long-hair trimmer, which comprises a plate-shaped reciprocatory cutter provided with cutting teeth which cooperate with the teeth of a similar stationary cutter. Obviously, it is alternatively possible to use such a motor for driving both a shaving member for cutting short hairs and a trimmer for cutting long hairs or to provide a switchable drive for these two. Moreover, mechanisms other than those described in the foregoing may be used for converting the rotary movement of the drive spindle into an oscillatory movement for driving the cutter or for multiplying the frequency of this oscillatory movement relative to the frequency of the rotary movement of the drive spindle.

What is claimed is:

1. A dry-shaving apparatus for connection to an a.c. source, which comprises at least one reciprocatory cutter; a self-starting single-phase synchronous motor having a drive spindle; and at least one drive mechanism coupling the drive spindle to the cutter for converting the rotary movement of the drive spindle into a reciprocating movement of the cutter; the relative position of the motor rotor about its axis with respect to the position of the cutter being selected so that in any rotor position in which the driving torque of the motor has zero value the cutter substantially occupies one of the two extreme positions in its reciprocating movement.

2. A dry-shaving apparatus as claimed in claim 1, which includes two drive mechanisms arranged to operate in series, the first drive mechanism being an eccentric mechanism and serving to convert the rotary movement of the drive spindle into an oscillatory movement for driving the cutter, the second drive mechanism serving to obtain a frequency of the oscillatory cutter-drive movement which is an integral multiple of the frequency of the rotary movement of the drive spindle.

3. A dry-shaving apparatus as claimed in claim 2, in which the second drive mechanism is constituted by a gear mechanism comprising at least two gear wheels, the first gear wheel being mounted on the drive spindle and the last gear wheel being coupled to an eccentric cooperating with the first drive mechanism.

4. A dry-shaving apparatus as claimed in claim 2, in which the second drive mechanism is constituted by a toggle mechanism having a drive arm acting on the free pivot of the toggle mechanism and being connected to an eccentric of the first drive mechanism, said eccentric being driven by the self-starting single-phase synchronous motor, the power take-off end of the toggle mechanism providing the oscillatory movement for driving the cutter.

5. A dry-shaving apparatus as claimed in claim 1, which includes a cam mechanism for converting the rotary movement of the drive spindle into an oscillatory movement for driving the cutter and for multiplying the frequency of the oscillatory cutter-drive movement by an integer relative to the frequency of the rotary movement of the drive spindle.

6. A dry-shaving apparatus as claimed in claim 5, in which the cam mechanism is a double-cam mechanism, the oscillatory movement for driving the cutter being jointly provided by the two adjacent cams of said double-cam mechanism, said cams being arranged at different angles relative to each other.

7. A dry-shaving apparatus as claimed in claim 5, in which the cam mechanism is constituted by a cam having a profile in the shape of an equilateral triangle with convexly, identically curved sides, the cam being drawn at its centre of gravity, and the oscillatory movement for driving the cutter being taken off at the circumference of the cam.

* * * * *